US008355664B2

(12) United States Patent
Eiki

(10) Patent No.: US 8,355,664 B2
(45) Date of Patent: Jan. 15, 2013

(54) CLEANING DEVICE FOR PHOTOSENSITIVE DRUM AND IMAGE FORMING APPARATUS EQUIPPED WITH CLEANING DEVICE

(75) Inventor: Takashi Eiki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 282 days.

(21) Appl. No.: 12/899,484

(22) Filed: Oct. 6, 2010

(65) Prior Publication Data

US 2011/0097123 A1 Apr. 28, 2011

(30) Foreign Application Priority Data

Oct. 22, 2009 (JP) ..... 2009-243158

(51) Int. Cl.
*G03G 21/00* (2006.01)

(52) U.S. Cl. ..... 399/349; 399/350; 399/357

(58) Field of Classification Search ..... 399/349, 399/350, 357

See application file for complete search history.

(56) References Cited

U.S. PATENT DOCUMENTS

| | | | | |
|---|---|---|---|---|
| 4,181,425 | A * | 1/1980 | Higaya et al. | 399/358 |
| 4,218,131 | A * | 8/1980 | Ito et al. | 399/350 |
| 4,674,865 | A * | 6/1987 | Tada et al. | 399/102 |
| 4,739,370 | A * | 4/1988 | Yoshida et al. | 399/347 |
| 4,899,198 | A * | 2/1990 | Mahoney | 399/302 |
| 4,974,030 | A * | 11/1990 | Tokunaga et al. | 399/347 |
| 4,989,048 | A * | 1/1991 | Arai et al. | 399/44 |
| 5,148,227 | A * | 9/1992 | Senba et al. | 399/349 |
| 6,701,122 | B2 * | 3/2004 | Maeshima et al. | 399/349 |
| 2003/0053831 | A1 * | 3/2003 | Maeshima et al. | 399/349 |
| 2005/0265745 | A1 * | 12/2005 | Takesawa et al. | 399/100 |

FOREIGN PATENT DOCUMENTS

| | | | |
|---|---|---|---|
| EP | 672970 | A2 * | 9/1995 |
| JP | 01136183 | A * | 5/1989 |
| JP | 04-122972 | | 4/1992 |
| JP | 05066701 | A * | 3/1993 |
| JP | 06083248 | A * | 3/1994 |
| JP | 08006451 | A * | 1/1996 |
| JP | 2008-176307 | | 7/2008 |

* cited by examiner

*Primary Examiner* — David Gray
*Assistant Examiner* — G. M. Hyder
(74) *Attorney, Agent, or Firm* — Frommer Lawrence & Haug LLP

(57) ABSTRACT

A cleaning device for a photosensitive drum includes a cleaning roller, a cleaning blade, and a layer control member. The layer control member may include an upstream scraper having a surface that surface contacts the cleaning roller in a substantially same direction as a rotation direction of the cleaning roller. In addition, the layer control member may include a downstream scraper having an edge that contacts the cleaning roller. The downstream scraper may be positioned downstream of the contact position between the cleaning roller and the upstream scraper in the rotation direction of the cleaning roller. In some embodiments, the downstream scraper edge may line contact the cleaning roller in a direction opposing the rotation direction of the cleaning roller.

16 Claims, 4 Drawing Sheets

CLEANING DEVICE FOR PHOTOSENSITIVE DRUM AND IMAGE FORMING APPARATUS EQUIPPED WITH CLEANING DEVICE

INCORPORATION BY REFERENCE

This application is based upon and claims the benefit of priority from the corresponding Japanese Patent application No. 2009-243158, filed Oct. 22, 2009, the entire contents of which are incorporated herein by reference.

FIELD OF THE INVENTION

The present disclosure relates to a cleaning device for a photosensitive drum, and an image forming apparatus in which a toner image is formed on the photosensitive drum and includes the cleaning device for the photosensitive drum.

BACKGROUND OF THE INVENTION

In an image forming apparatus with an electrophotographic system, a charging unit electrically charges a photosensitive drum in advance, and an exposure unit emits light on a surface of the photosensitive drum. Then, an electrostatic latent image is formed on the surface of the photosensitive drum. A developing unit bears toner. The toner adheres to the electrostatic latent image to form a toner image. The toner image is transferred on and fixed to a sheet.

After the toner is transferred on the sheet, a small quantity of the toner may not be transferred and remain on the surface of the photosensitive drum. The remaining toner may affect the formation of the next image(s). Therefore, a device that cleans the surface of the photosensitive drum has been utilized.

More specifically, a cleaning roller and a cleaning blade may be used to contact the surface of the photosensitive drum. The toner contains a very small quantity of an external additive. The cleaning roller uses the toner containing the external additive to remove substances, such as corona discharge products adhering to the surface of the photosensitive drum.

Also, a scraper contacts the cleaning roller. The scraper controls the thickness of a layer of the toner being held on the cleaning roller. If the thickness of the layer of the toner is uneven, a smaller-thickness portion of the layer of the toner may not effectively polish the surface of the photosensitive drum. In contrast, in a larger-thickness portion of the layer of the toner, the electric charge of the toner is hardly discharged, and the photosensitive drum may be electrostatically damaged. Unfortunately, the above mentioned conventional structure still has a problem in providing for a proper quantity of the remaining toner adhering to and being held by the cleaning roller.

This is because the scraper only line contacts the cleaning roller in a counter direction with respect to a rotation direction of the cleaning roller. In other words, the scraper contacts the cleaning roller only by point contact in a sectional view along a plane substantially orthogonal to a rotation axis of the cleaning roller. Hence, most of the remaining toner is scraped away from the cleaning roller and is hardly held by the cleaning roller.

In this state, it is difficult to continuously and effectively polish the surface of the photosensitive drum. Also, the external additive in the toner may adhere to the surface of the photosensitive drum, be separated from the surface of the photosensitive drum, and contaminate the charging unit.

SUMMARY OF THE INVENTION

Accordingly, this disclosure provides a cleaning device capable of allowing remaining toner of a proper quantity to adhere to the surface of the cleaning roller and be held on the surface of the cleaning roller, and an image forming apparatus including the cleaning device.

A cleaning device for a photosensitive drum according to an aspect of the present disclosure includes a cleaning roller configured to contact a surface of the photosensitive drum and polish the surface of the photosensitive drum with the rotation thereof; a cleaning blade configured to contact the surface of the photosensitive drum at a position located downstream the contact position between the surface of the photosensitive drum and the cleaning roller in a rotation direction of the photosensitive drum and remove remaining toner from the surface of the photosensitive drum; and a layer control member configured to contact the cleaning roller and control a thickness of the remaining toner adhering to the cleaning roller. The layer control member includes an upstream scraper that surface contacts the cleaning roller in a trail direction with respect to the rotation direction of the cleaning roller, and a downstream scraper having an edge that contacts the cleaning roller at a position located downstream the contact position between the cleaning roller and the upstream scraper in the rotation direction of the cleaning roller, and that line contacts the cleaning roller in a counter direction with respect to the rotation direction of the cleaning roller.

The above and other objects, features, and advantages of various embodiments of the present disclosure will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

Various features of novelty which characterize various aspects of the invention are pointed out in particularity in the claims annexed to and forming a part of this disclosure. For a better understanding of the invention, operating advantages and specific objects that may be attained by some of its uses, reference is made to the accompanying descriptive matter in which exemplary embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which.

DETAILED DESCRIPTION OF THE EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents.

Figure 1:
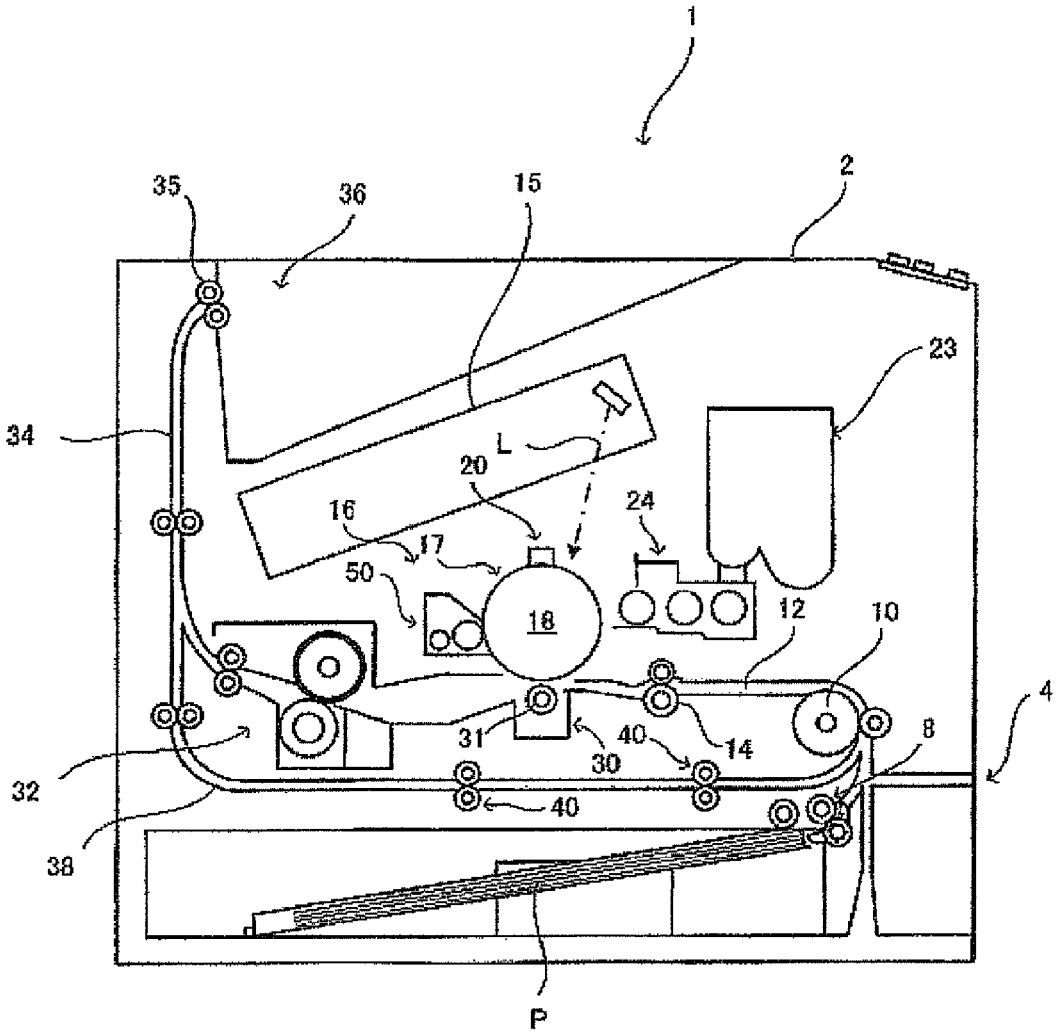
FIG. 1 is a schematic view of the entire structure of an image forming apparatus according to an embodiment.

FIG. 1 shows a structure of printer 1 for monochrome printing as an example of image forming apparatus. A sectional view in FIG. 1 is viewed from a left side surface of printer 1. Thus, a front surface of printer 1 is located on the right in FIG. 1, and a rear surface is located on the left.

Referring to FIG. 1, printer 1 includes apparatus main body 2. Sheet-feed cassette 4 is disposed in a lower portion of apparatus main body 2. Cut sheets P are stacked and accommodated in cassette 4. The sheet P is fed toward the upper right side of cassette 4 in FIG. 1. The fed sheet P is reversed toward the rear surface of apparatus main body 2 in apparatus main body 2, and conveyed toward the rear surface.

Cassette 4 can be pulled out to the right in FIG. 1. When cassette 4 is pulled out, the additional sheets P may be replenished in cassette 4, or the sheets P may be replaced with another type of sheet.

In apparatus main body 2, as shown in FIG. 1, feed roller 10, sheet-conveyance path 12 of feeder side, registration roller pair 14, and image forming unit 16 are arranged downstream of cassette 4 in that order in a sheet-conveyance direction.

In some embodiments, image forming unit 16 includes drum unit 17 having photosensitive drum 18. Photosensitive drum 18 is rotatably disposed and rotationally driven clockwise in FIG. 1 by driving motor (not shown). According to an embodiment, photosensitive drum 18 may be an amorphous silicon (a-Si) drum having an amorphous silicon layer on a surface of the drum.

In some embodiments, charging unit 20, exposing unit 15, developing unit 24, transferring unit 30, and cleaning unit 50 are disposed at positions around photosensitive drum 18.

Figure 2:
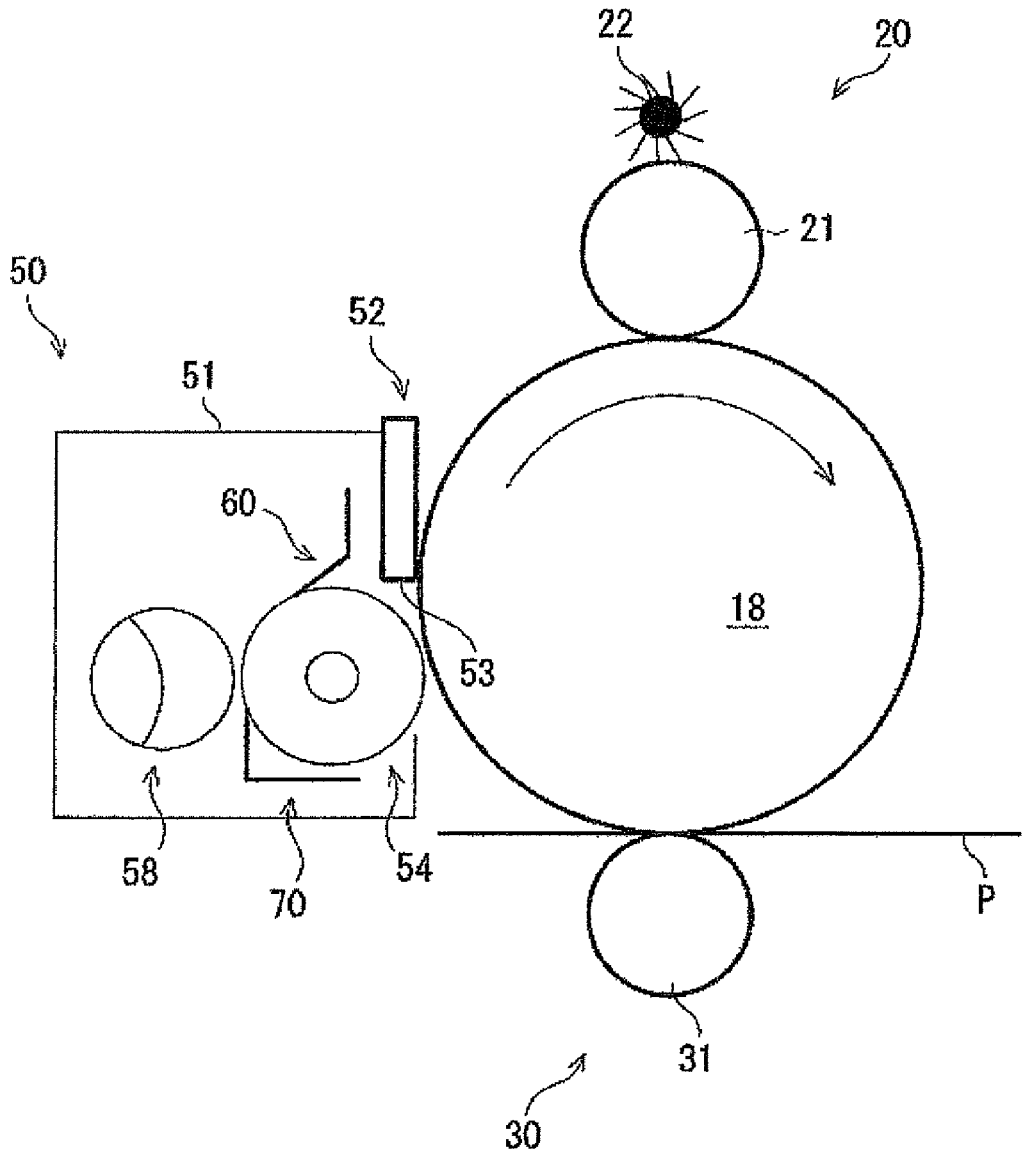
FIG. 2 is an enlarged view showing a part around a drum unit in FIG. 1.

Various embodiments include charging unit 20 disposed above drum unit 17. Referring to FIG. 2, charging unit 20 includes charging roller 21 that directly contacts photosensitive drum 18, and cleaning brush 22 that cleans the surface of charging roller 21 by polishing and brushing. Charging unit 20 uniformly charges the surface of photosensitive drum 18. Charging roller 21 has a surface layer made of, for example, epichlorohydrin rubber, ethylene propylene methylene linkage (EPDM), polychloroprene rubber (CR), and/or polyurethane rubber.

Referring back to FIG. 1, exposing unit 15 is arranged above drum unit 17. The exposing unit 15 emits laser light L in accordance with desirable image data to photosensitive drum 18, and forms an electrostatic latent image on the surface of photosensitive drum 18. In some embodiments, as is shown in FIG. 1, developing unit 24 is arranged on the right of drum unit 17. Developing unit 24 causes toner supplied from toner container 23 to electrostatically adhere to the surface of photosensitive drum 18 to form a toner image.

Transferring unit 30 is arranged below drum unit 17, and includes transferring roller 31. In various embodiments, transferring roller 31 can contact photosensitive drum 18. In some embodiments, transferring roller 31 may apply pressure to photosensitive drum 18 from below. Photosensitive drum 18 and transferring roller 31 form a transfer nip portion at which a toner image is transferred onto sheet P.

As is illustrated in FIG. 1, fixing unit 32, sheet-conveyance path 34 of discharging side, and discharged sheet tray 36 are arranged downstream of transferring unit 30 in that order in the sheet-conveyance direction.

As shown in FIG. 1, sheet-conveyance path 34 extends from a position located downstream of fixing unit 32 to the upper side along the rear surface of apparatus main body 2. FIG. 1 depicts sheet-conveyance path 34 is curved at an upper portion in apparatus main body 2 toward the front surface (to the right in FIG. 1). If printing is performed only on one side of a sheet P, the sheet P passes through fixing unit 32, and then is output to discharged sheet tray 36 through discharging roller pair 35. Such sheets are stacked in a height direction on discharged sheet tray 36. The printed sheets P stacked on discharged sheet tray 36 are easily accessible from the outside.

In various embodiments, sheet-conveyance path 38 for duplex printing is formed between cassette 4 and the parts which include transferring unit 30 and fixing unit 32. Some embodiments may include sheet-conveyance path 38 branching from sheet-conveyance path 34 at a position along the rear surface of apparatus body 2, extending to the lower side, curving toward the front surface of printer 1, extending in the horizontal direction, extending to the upstream side of registration roller pair 14, and meeting sheet-conveyance path 12 at a position between roller pair 8 and feed roller 10 upstream registration roller pair 14 in the sheet conveyance direction of sheet-conveyance path 12. The sheet P in sheet-conveyance path 38 is conveyed by a plurality of conveying roller pairs 40 to sheet-conveyance path 12.

In some embodiments, as shown in FIG. 2, cleaning unit 50 includes housing 51 at a position located downstream of the transfer position formed by the photosensitive drum 18 and transferring roller 31 when viewed according to a rotation direction of the photosensitive drum 18. As shown in FIG. 2, housing 51 is open to photosensitive drum 18, and includes cleaning blade 52, polishing roller (an example of a cleaning roller) 54, and toner recovery unit 58 at proper positions in the housing 51.

Figure 3:
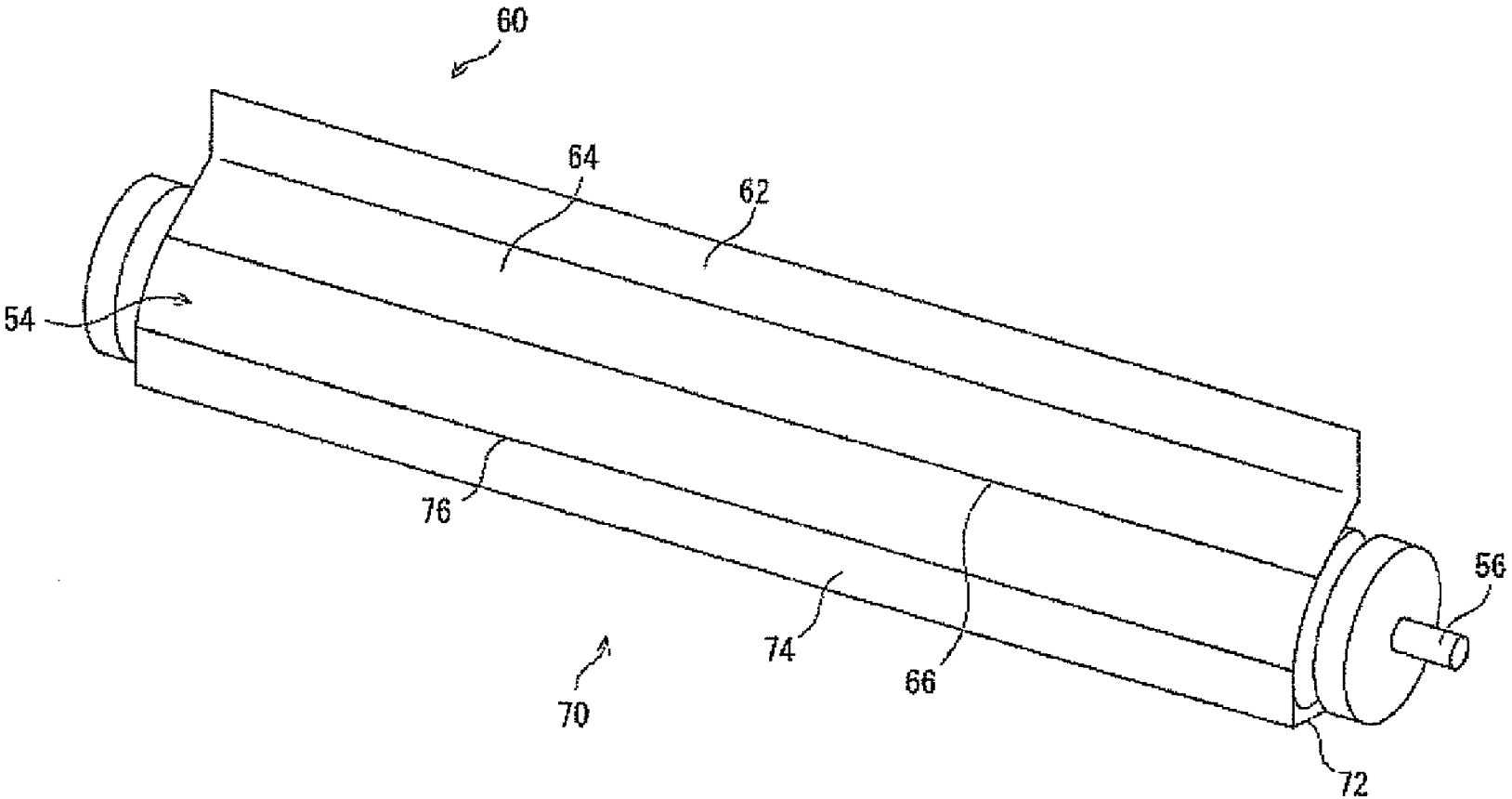
FIG. 3 is a perspective view showing a cleaning roller and a layer control member in FIG. 2.
Figure 4:
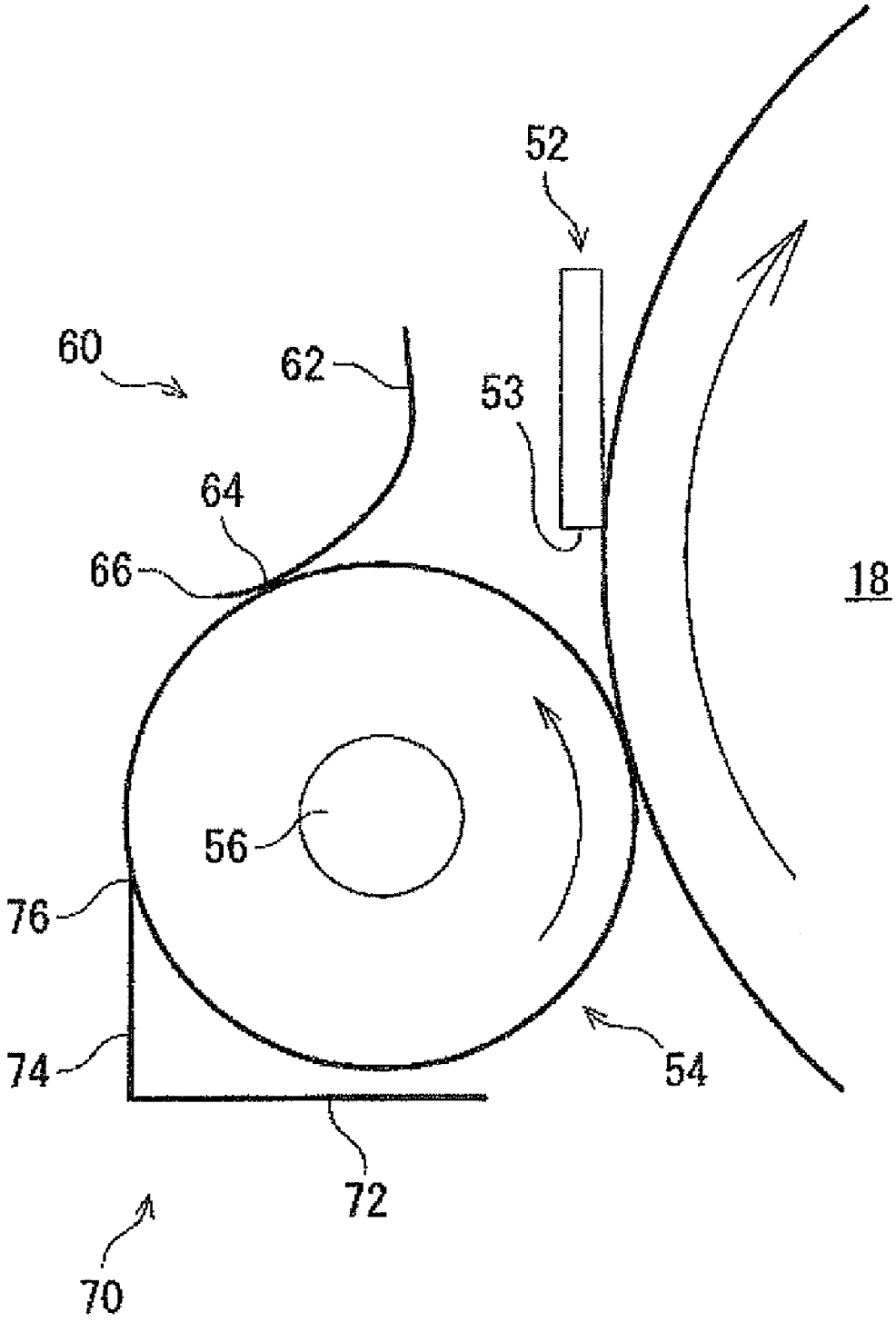
FIG. 4 is an enlarged view showing a part around the cleaning roller in FIG. 2.

As shown in FIG. 2, polishing roller 54 faces photosensitive drum 18 at the opening of housing 51. Polishing roller 54 extends along a rotation axis of photosensitive drum 18. As depicted in FIG. 3, polishing roller 54 includes rotating shaft 56 that is rotatably supported by housing 51. FIG. 4 illustrates polishing roller 54 is driven counterclockwise by a driving motor (not shown). In other words, in some embodiments, the surface of polishing roller 54 and the surface of photosensitive drum 18 rotate in the same direction at mutually facing positions. Thus, polishing roller 54 rubs and polishes the surface of photosensitive drum 18 in a trail direction after the toner image is transferred. Polishing roller 54 may be formed of, for example, conductive foamed ethylene propylene diene monomer (EPDM), nitrile butadiene rubber (NBR), and/or foamed melamine resin. A rubbing surface of polishing roller 54 contacts the surface of photosensitive drum 18 at a predetermined linear velocity ratio when the image forming is done.

Accordingly, in some embodiments, the rubbing surface of polishing roller 54 removes, for example, discharge products adhering to the surface of the amorphous silicon layer of photosensitive drum 18.

As shown in FIG. 2, some embodiments may include cleaning blade 52 having a main body fixed to an upper end of housing 51, and a blade portion made of polyurethane rubber. In some embodiments, the blade portion and the main body of the cleaning blade may be separate components that are mechanically coupled to each other. For example, the blade portion may be welded to the main body. As depicted in FIG. 2, with respect to the rotation direction of photosensitive drum 18, the blade portion has edge 53 arranged downstream of a rubbing position at which polishing roller 54 rubs the surface of photosensitive drum 18. In some embodiments, edge 53 extends along the rotation axis of photosensitive drum 18. As shown in FIG. 2, edge 53 contacts photosensitive drum 18 after polishing roller 54 and scrapes the remaining toner and the like adhering to the surface of photosensitive drum 18.

The remaining toner and the like scraped away from the surface of photosensitive drum 18 by cleaning blade 52 and polishing roller 54 accumulates in an area near edge 53 of cleaning blade 52. In some embodiments, a small quantity of an external additive (for example, titanium oxide, silica, or alumina) is externally added to the toner. Polishing roller 54 polishes the surface of photosensitive drum 18 by using the toner to which external additive is added.

In some embodiments, the toner removed from photosensitive drum 18 by polishing roller 54 and cleaning blade 52 may be allowed to temporarily accumulate in the area near edge 53. Then, the toner may adhere to polishing roller 54.

In some embodiments, the thickness of the remaining toner adhering to polishing roller 54 can be controlled. For example, the thickness of the toner adhering to the polishing roller may be controlled using a layer control member. Various embodiments may include multiple layer control members.

As shown in FIG. 2, an embodiment may include two layer control members, for example, upstream scraper 60 and downstream scraper 70 contact the polishing roller 54.

FIGS. 2 to 4 depict upstream scraper 60 disposed above polishing roller 54. Thus, upstream scraper 60 is disposed downstream of the contact position between polishing roller 54 and photosensitive drum 18 in the rotation direction of polishing roller 54, at a position near the contact position between edge 53 and photosensitive drum 18.

In some embodiments, upstream scraper 60 substantially has an inverse L-shape with an obtuse angle as shown in the sectional view in FIG. 4. As depicted, upstream scraper 60 includes support portion 62 arranged above rotating shaft 56 and extending in a substantially vertical direction, and contact portion 64 coupled to a lower end of support portion 62 and extending in the substantially same direction as the rotation direction of polishing roller 54 (e.g., in the trail direction).

As depicted in FIG. 4, various embodiments include contact portion 64 which is bent along the rubbing surface of polishing roller 54 at a position located downstream of the top of polishing roller 54 in the rotation direction of polishing roller 54, i.e., at a position on the left of a perpendicular bisector of polishing roller 54 passing through rotating shaft 56. In some embodiments, the contact portion 64 contacts the rubbing surface of polishing roller 54 by surface contact. Contact portion 64 has edge 66 at a distal end thereof. Embodiment may include edge 66 being slightly lifted from the rubbing surface of polishing roller 54 as is illustrated in FIG. 4.

FIG. 3 illustrates that in some embodiments, upstream scraper 60 extends along the rotation axis of photosensitive drum 18 in a manner similar to cleaning blade 52 and polishing roller 54. In some embodiments, the properties of the scrapers may vary. For example, materials selected for the scrapers may differ. Materials may be selected for particular properties including, but not limited to stiffness, elastic modulus, impact resistance, etc. Various embodiments include upstream scraper 60 formed of a material with a lower stiffness (e.g., a polyethylene terephthalate ("PET") film) than the stiffness of downstream scraper 70 that is formed, for example, of stainless steel. The material of upstream scraper 60 has a modulus of longitudinal elasticity (Young's modulus) of, for example, 4 GPa.

In some embodiments, the modulus of longitudinal elasticity of the material of the upstream scraper 60 may be in a range from about 2.0 to about 40 GPa so as not to cause the remaining toner to be excessively accumulated in the area near contact portion 64. While for upstream scraper 60, multiple types of PET films and multiple types of stainless steel plates with a thickness of 50 μm (1 μm=$1\times10^{-6}$ m) are utilized, the remaining toner may not be scraped from polishing roller 54 and accumulated if the modulus of longitudinal elasticity is smaller than 2.0 GPa. A scraper formed of these material may not be effective. In contrast, if the modulus of longitudinal elasticity is larger than 40 GPa, the remaining toner may accumulate excessively. Thus, an area surrounded by cleaning blade 52, photosensitive drum 18, and upstream scraper 60 may be clogged with the toner. If the toner is clogged in an area, toner particles may generate friction, resulting in the toner being excessively electrically charged. If this occurs, discharge may occur between the toner and photosensitive drum 18, and photosensitive drum 18 may be damaged. Therefore, clogging with the toner has to be avoided. In some embodiments, the modulus of longitudinal elasticity of upstream scraper 60 may be in a range from about 3.0 to about 5.0 GPa.

When polishing roller 54 is driven, upstream scraper 60, in particular, contact portion 64 thereof pushes the toner to the rubbing portion of polishing roller 54 in housing 51. In some embodiments, the toner pushed to the rubbing portion of polishing roller 54 is the amount necessary to polish photosensitive drum 18. Thus, the thickness of the remaining toner adhering to the rubbing surface of polishing roller 54 can be controlled uniformly.

In various embodiments, downstream scraper 70 is disposed downstream of the contact position between polishing roller 54 and contact portion 64 in the rotation direction of polishing roller 54. In other words, downstream scraper 70 may be arranged opposite the contact position between polishing roller 54 and photosensitive drum 18 with respect to rotating shaft 56.

Various embodiments include downstream scraper 70 having substantially an L-shape as is shown in the sectional view in FIG. 4. As depicted downstream scraper 70 includes support portion 72 and arm portion 74. In some embodiments, support portion 72 is arranged below rotating shaft 56 and extends in a substantially horizontal direction (in FIG. 4, in a substantially left-right direction). Various embodiments include arm portion 74 coupled to a left end of support portion 72 and extending substantially perpendicularly to support portion 72 (in FIG. 4, substantially upward), i.e., extending in a direction substantially opposing the rotation direction of polishing roller 54.

In various embodiments, as depicted in FIG. 4, arm portion 74 has edge 76 at a distal end thereof, and the edge 76 line contacts the rubbing surface of polishing roller 54. Some embodiments may include edge 76 which contacts the rubbing surface of polishing roller 54 along the length of polishing roller 54. For example, in a sectional view along a plane substantially orthogonal to rotating shaft 56, edge 76 may contact the rubbing surface of polishing roller 54 at essentially a point (i.e., a point contact). Various embodiments include downstream scraper 70 which extends along the rotation axis of polishing roller 54 like upstream scraper 60 (shown in FIG. 3). When polishing roller 54 is driven, downstream scraper 70, in particular, edge 76 scrapes excessive remaining toner adhering to the rubbing surface of polishing roller 54 into housing 51. Excessive remaining toner may refer to any quantity of toner remaining on the surface of the polishing roller 54 which exceeds the quantity necessary for polishing photosensitive drum 18. Thus, downstream scraper 70 can control the thickness of the remaining toner. In some embodiments, the excessive remaining toner scraped away by downstream scraper 70 is recovered by toner recovery unit 58 as shown in FIG. 2.

Various embodiments include toner recovery unit 58 having a screw near a rear surface of housing 51. The screw is arranged on the left of polishing roller 54 in FIG. 2. The screw extends along the rotation axis of photosensitive drum 18, and a distal end of the screw is coupled with a driving motor (not shown). When the driving motor is driven, the remaining toner scraped by downstream scraper 70 in the housing 51 is collected in a recovery container (not shown) with the screw.

In some embodiments, when the printer 1 with drum unit 17 mounted therein prints, sheets P are fed from cassette 4 while roller pair 8 separates the sheets P one by one. The fed sheet P passes through sheet-conveyance path 12 and reaches registration roller pair 14. Registration roller pair 14 sends the sheet P to transferring unit 30 at a predetermined sheet-feed timing, i.e., in consideration of a transfer timing in which the toner image formed by image forming unit 16 is transferred to the sheet P while correcting a skew of the sheet P Charging unit 20 electrically charges the surface of photosensitive drum 18. When exposing unit 15 emits laser light L onto the surface of photosensitive drum 18 in accordance with the image data, an electrostatic latent image is formed on the surface of photosensitive drum 18.

When a development bias voltage is applied to developing unit 24, the toner from toner container 23 adheres to the surface of photosensitive drum 18 because of a potential difference between the electrostatic latent image formed on surface of the photosensitive drum 18 and the development bias voltage. Thus, a toner image corresponding to the electrostatic latent image is formed on the surface of photosensitive drum 18.

When the sheet P passes through the portion between photosensitive drum 18 and transferring roller 31, the toner image formed on the surface of photosensitive drum 18 is transferred on the sheet P at the nip portion. After the transferring, cleaning unit 50 removes the toner remaining on the surface of photosensitive drum 18.

The sheet P bearing the unfixed toner image is sent to fixing unit 32. At fixing unit 32, the toner image on the sheet P is heated by a heat roller at a predetermined temperature and pressed between the heat roller and a pressure roller. Thus, the toner image is fixed to the sheet P. The sheep P from fixing unit 32 is output to sheet-output tray 36.

The above process is for simplex printing (one-side printing). If duplex printing (both-side printing) is performed, the conveyance direction of the sheet P from fixing unit 32 is changed immediately before the sheet P is output to sheet-output tray 36. That is, the sheet P with a print on one side is moved back into apparatus main body 2, and is sent again to transferring unit 30 through sheet-conveyance path 38 and registration roller pair 14. Hence, a toner image is transferred on a not printed side of the sheet P.

As described above, in this embodiment, the toner image is formed on the surface of photosensitive drum 18 and is transferred on the sheet P. Polishing roller 54 and cleaning blade 52 remove the toner (the remaining toner) adhering to and remaining on the surface of photosensitive drum 18. The remaining toner adheres to polishing roller 54, and is used for cleaning the surface of photosensitive drum 18.

In some embodiments, printer 1 may include upstream scraper 60 to control the thickness of the remaining toner adhering to polishing roller 54. As is shown in FIG. 4, upstream scraper 60 includes contact portion 64 that surface contacts polishing roller 54 in the trail direction with respect to the rotation direction of polishing roller 54 so that contact portion 64 presses the rubbing surface of polishing roller 54. If the thickness of the remaining adhering toner varies, the remaining toner is pressed by contact portion 64, so that the remaining toner is more evenly distributed. For example, toner may be moved from an area having a thicker layer of toner to an area having a thinner layer of toner. Thus, the thickness of the remaining toner on polishing roller 54 can be equalized along the length of rotating shaft 56 of polishing roller 54. That is, upstream scraper 60 may equalize the thickness of the layer of the toner adhering to the rubbing surface of polishing roller 54.

In some embodiments, printer 1 includes downstream scraper 70. Downstream scraper 70 includes edge 76 that line contacts polishing roller 54 in the counter direction opposite the rotation direction of polishing roller 54. Downstream scraper 70 can further control the quantity of the remaining toner adhering to polishing roller 54. Even if a foreign matter such as paper dust comes between upstream scraper 60 and the rubbing surface of polishing roller 54, and thus upstream scraper 60 cannot equalize the thickness of the remaining toner, the toner in the portion having a thicker layer can be scraped and the thickness of the toner layer can be equalized by the downstream scraper 70. Further, if the thickness of the toner layer on polishing roller 54 which has already been equalized by upstream scraper 60 is too large, the thickness of the toner layer can be equalized by downstream scraper 70.

In some embodiments, a combination of upstream scraper 60 and downstream scraper 70 may be used. As described above, by combining upstream scraper 60 having surface contact with polishing roller 54 and downstream scraper 70 having line contact with polishing roller 54, the remaining toner on polishing roller 54 is not excessively scraped. In contrast, when using two scrapers both of which have line contact with polishing roller 54, excessive scraping may occur. Upstream scraper 60 surface contacts the rubbing surface of polishing roller 54 in the trail direction with respect to the rotation direction of polishing roller 54 and maintains the uniform adhering quantity in the axial direction of polishing roller 54. For example, upstream scraper 60 may be configured to allow a predetermined thickness of toner to remain on the polishing roller 54. This predetermined thickness may vary based on, for example, transport speed of paper, adding amount of external additive to the toner, and/or kind of methods for charging the photosensitive drum. Then, downstream scraper 70 line contacts the rubbing surface of polishing roller 54 in the counter direction with respect to the rotation direction of polishing roller 54 and scrapes the excess quantity of the toner adhering on polishing roller 54. Accordingly, a predetermined thickness of the remaining toner can adhere to and be held on the rubbing surface of polishing roller 54. Thus, the polishing roller 54 can continuously effectively polish the surface of the photosensitive drum 18. In some embodiments, the predetermined thickness of toner on polishing roller 54 is a quantity sufficient to effectively polish the surface of photosensitive drum 18.

Consequently, the friction coefficient of the surface of photosensitive drum 18 can be maintained low, and the external additive in the toner can also be inhibited and/or prevented from adhering to the surface of photosensitive drum 18.

This effect will be described in detail below with respect to some examples. Under the condition in which above-described cleaning brush 22 was removed from charging unit 20, an image with a coverage rate of 4% was printed on 3000 sheets, and the surface of charging roller 21 that directly contacts photosensitive drum 18 was observed.

The color of the surface of charging roller 21 was black when it was not used, and the surface had a Y-value of 4.58, the Y-value being representative of a brightness in an XYZ color system.

If upstream scraper 60 and downstream scraper 70 were not provided to printer 1, the color of the surface of charging roller 21 became white, and the surface had a Y-value of 10.03. It may be because the surface of photosensitive drum 18 was not effectively polished, the external additive in the toner adhered to the surface of photosensitive drum 18, the external additive reached charging roller 21 from the surface of photosensitive drum 18, and the external additive contaminated charging roller 21.

In contrast, if upstream scraper 60 and downstream scraper 70 were provided to printer 1, the color of the surface of charging roller 21 became a color close to black, and the surface had a Y-value of 5.74. It is found that the external additive in the toner can be prevented from adhering to charging roller 21, and hence the external additive does not contaminate charging roller 21.

In addition, with the above mentioned examples, the surface of photosensitive drum 18 is effectively polished, and good image formation can be performed for a long period of time. This may contribute to improving reliability of printer 1.

In some embodiments, upstream scraper 60 surface contacting the rubbing surface of polishing roller 54 in the trail direction with respect to the rotation direction of polishing roller 54 is arranged near the contact position between photosensitive drum 18 and cleaning blade 52. Hence, the toner can be accumulated in the area near edge 53 of cleaning blade 52 by a proper quantity, as compared with the case in which the scraper line contacting the rubbing surface of polishing roller 54 is provided and the scraper excessively scrapes the remaining toner adhering on the rubbing surface polishing roller 54 and accumulates the remaining toner removed by cleaning blade 52 by a excessive quantity in the area near edge 53 of cleaning blade 52. The external additive can be further reliably inhibited and/or prevented from being moved to charging unit 20, and the remaining toner near edge 53 can be inhibited and/or prevented from being excessively charged.

With this embodiment, since downstream scraper 70 has a scraping function for the rubbing surface of polishing roller 54, variation in thickness of the remaining toner can be further reliably handled, as compared with the case in which two scrapers surface contacting the rubbing surface of polishing roller 54 are provided.

In various embodiments, pressure at the juncture of contact portion 64 and the rubbing surface of polishing roller 54 may be adjusted to control removal of the excess toner on polishing roller 54. For example, if a contact pressure of contact portion 64 of upstream scraper 60 to the rubbing surface of polishing roller 54 is decreased, the excessive remaining toner accumulated at a position near upstream scraper 60, i.e., in an area between edge 53 and contact portion 64, can be quickly moved to downstream scraper 70, and downstream scraper 70 can scrape the moved toner. Thus, the control for the accumulated quantity of the remaining toner can be quickly completed.

In various embodiments, contact portion 64 of upstream scraper 60 contacts the rubbing surface of polishing roller 54 at a position located downstream of the top of polishing roller 54 in the rotation direction of polishing roller 54. Accordingly, the remaining toner does not excessively accumulate at a position near upstream scraper 60, i.e., the area between edge 53 and contact portion 64. This configuration may inhibit and/or prevent creating an excessive charge in the remaining toner. In contrast, if contact portion 64 of upstream scraper 60 contacts the rubbing surface of polishing roller 54 at a position located upstream of the top of polishing roller 54, the remaining toner may accumulate excessively in the area between edge 53 and contact portion 64. In such cases, the remaining toner may become excessively electrically charged. If such an excessive electrical charge is discharged, there is a possibility that the photosensitive layer of photosensitive drum 18 may be damaged.

In some embodiments, the photosensitive drum utilized may be, but is not limited to an a-Si photosensitive drum having an amorphous silicon layer. The a-Si photosensitive drum having the amorphous silicon layer has a high surface hardness. Thus, the life of the a-Si photosensitive drum is long. However, since the a-Si photosensitive drum has the high surface hardness, if discharge products adhere to the surface, the discharge products may remain on the surface without being scraped by a cleaning blade or the like due to the hard surface. An electrostatic latent image may be disordered when the image is formed in a high-humidity environment. In other words, an image smearing phenomenon may occur. If above-described scrapers 60 and 70 are provided, the characteristics of the photosensitive drum can be maintained for a long period of time. The advantage of the photosensitive drum can be effectively leveraged.

The present disclosure is not limited to the above-described embodiment, and may be modified in various forms within the scope of the claims.

For example, a photosensitive drum according to the present disclosure may be applied to an organic photosensitive drum ("OPC") having an organic layer on a surface of the drum. Also, in the embodiment, an example for implementing an image forming apparatus is the printer. However, an image forming apparatus according to the present disclosure may be applied to a multi functional peripheral, a copier, a facsimile, etc.

Also in any of these examples, the remaining toner can adhere to and be held on the cleaning roller by a proper quantity.

Having thus described in detail embodiments of the present invention, it is to be understood that the invention disclosed by the foregoing paragraphs is not to be limited to particular details and/or embodiments set forth in the above description, as many apparent variations thereof are possible without departing from the spirit or scope of the present invention.

What is claimed is:

1. A cleaning device for a photosensitive drum, comprising:

a cleaning roller configured to contact a surface of the photosensitive drum and polish the surface of the photosensitive drum with the rotation thereof relative to the surface of the photosensitive drum;

a cleaning blade configured to contact the surface of the photosensitive drum at a position located downstream the contact position between the surface of the photosensitive drum and the cleaning roller in a rotation direction of the photosensitive drum and remove remaining toner from the surface of the photosensitive drum; and a layer control member configured to contact the cleaning roller and control a thickness of the remaining toner adhering to the cleaning roller, wherein the layer control member comprises:

an upstream scraper having a surface configured to surface contact the cleaning roller in a substantially same direction as the rotation direction of the cleaning roller, and a downstream scraper having an edge configured to line contact the cleaning roller (i) at a position located downstream of the contact position between the cleaning roller and the upstream scraper in the rotation direction of the cleaning roller and (ii) in a direction opposing the rotation direction of the cleaning roller.

2. The cleaning device for the photosensitive drum according to claim 1, wherein the upstream scraper is arranged proximate the contact position between the photosensitive drum and the cleaning blade.

3. The cleaning device for the photosensitive drum according to claim 1, wherein the upstream scraper comprises:

a support portion extending in a substantially vertical direction, and a contact portion coupled to a lower end of the support portion and extending in a substantially same direction with respect to the rotation direction of the cleaning roller, and wherein the contact portion of the upstream scraper comprises the surface that surface contacts the cleaning roller.

4. The cleaning device for the photosensitive drum according to claim 1, wherein the downstream scraper comprises:

a support portion extending in a substantially horizontal direction, and an arm portion coupled to one end of the support portion, extending in a direction substantially perpendicular to the support portion, and having the edge at an end of the arm portion.

5. The cleaning device for the photosensitive drum according to claim 1, wherein the upstream scraper comprises a contact portion that surface contacts the cleaning roller and is formed of a material with a lower stiffness than a stiffness of a material of the downstream scraper, and wherein the upstream scraper has a modulus of longitudinal elasticity in a range from about 2.0 to about 40 GPa.

6. The cleaning device for the photosensitive drum according to claim 1, wherein the upstream scraper comprises a contact portion that surface contacts the cleaning roller at a position located downstream of a top of the cleaning roller in the rotation direction of the cleaning roller.

7. The cleaning device for the photosensitive drum according to claim 1, wherein the upstream scraper comprises a contact portion that surface contacts the cleaning roller, and a distal end of the contact portion is lifted from a surface of the cleaning roller.

8. The cleaning device for the photosensitive drum according to claim 1, wherein the photosensitive drum comprises an amorphous silicon layer on the surface of the photosensitive drum.

9. An image forming apparatus, comprising:

a photosensitive drum configured to bear a toner image on the surface thereof;

a cleaning roller configured to contact the surface of the photosensitive drum and polish the surface of the photosensitive drum with the rotation thereof relative to the surface of the photosensitive drum;

a cleaning blade configured to contact the surface of the photosensitive drum at a position located downstream the contact position between the surface of the photosensitive drum and the cleaning roller in a rotation direction of the photosensitive drum and remove remaining toner from the surface of the photosensitive drum; and a layer control member configured to contact the cleaning roller and control a thickness of the remaining toner adhering to the cleaning roller, wherein the layer control member comprises:

an upstream scraper having a surface configured to surface contact the cleaning roller in substantially same direction as the rotation direction of the cleaning roller, and a downstream scraper having an edge configured to line contact the cleaning roller (i) at a position located downstream of the contact position between the cleaning roller and the upstream scraper in the rotation direction of the cleaning roller and (ii) in a direction opposing the rotation direction of the cleaning roller.

10. The image forming apparatus according to claim 9, wherein the upstream scraper is arranged proximate the contact position between the photosensitive drum and the cleaning blade.

11. The image forming apparatus according to claim 9, wherein the upstream scraper comprises:

a support portion extending in a substantially vertical direction, and a contact portion coupled to a lower end of the support portion and extending in a substantially same direction as the rotation direction of the cleaning roller, and wherein the contact portion of the upstream scraper comprises the surface that surface contacts the cleaning roller by surface contact.

12. The image forming apparatus according to claim 9, wherein the downstream scraper comprises:

a support portion extending in a substantially horizontal direction, and an arm portion coupled to one end of the support portion, extending in a direction substantially perpendicular to the support portion, and having the edge at an end of the arm portion.

13. The image forming apparatus according to claim 9, wherein the upstream scraper comprises a contact portion that surface contacts the cleaning roller and is formed of a material with a lower stiffness than a stiffness of a material of the downstream scraper, and wherein the upstream scraper has a modulus of longitudinal elasticity in a range from about 2.0 GPa to about 40 GPa.

14. The image forming apparatus according to claim 9, wherein the upstream scraper comprises a contact portion that surface contacts the cleaning roller at a position located downstream of a top of the cleaning roller in the rotation direction of the cleaning roller.

15. The image forming apparatus according to claim 9, wherein the upstream scraper comprises a contact portion that surface contacts the cleaning roller, and a distal end of the contact portion is lifted from a surface of the cleaning roller.

16. The image forming apparatus according to claim 9, wherein the photosensitive drum comprises an amorphous silicon layer on the surface of the photosensitive drum.

* * * * *